US009321068B2

(12) United States Patent
Hasegawa

(10) Patent No.: US 9,321,068 B2
(45) Date of Patent: Apr. 26, 2016

(54) SWING NOZZLE

(75) Inventor: Kaga Hasegawa, Tokyo (JP)

(73) Assignee: GA-REW Corporation, Tokyo (JP)

( * ) Notice: Subject to any disclaimer, the term of this patent is extended or adjusted under 35 U.S.C. 154(b) by 0 days.

(21) Appl. No.: 14/239,222

(22) PCT Filed: Mar. 28, 2012

(86) PCT No.: PCT/JP2012/058075

§ 371 (c)(1),
(2), (4) Date: Feb. 17, 2014

(87) PCT Pub. No.: WO2013/031269

PCT Pub. Date: Mar. 7, 2013

(65) Prior Publication Data

US 2014/0191066 A1 Jul. 10, 2014

(30) Foreign Application Priority Data

Mar. 2, 2011 (JP) ..... 2011-045069
Aug. 31, 2011 (JP) ..... 2011-188638

(51) Int. Cl.
*B05B 15/08* (2006.01)
*B05B 13/06* (2006.01)

(52) U.S. Cl.
CPC ..... *B05B 15/08* (2013.01); *B05B 13/0636* (2013.01); *B05B 13/0627* (2013.01)

(58) Field of Classification Search
CPC ..... B05B 15/08; B05B 3/02; B05B 15/066; B05B 15/067; B05B 15/061
USPC ..... 239/587.5, 587.6, 225.1, 227, 587.1, 239/588, 324, 532; 169/24, 25
See application file for complete search history.

(56) References Cited

U.S. PATENT DOCUMENTS 1,752,193 A * 3/1930 O'Hanlon ..... B05B 1/00 239/525
4,351,478 A * 9/1982 Looper ..... B08B 9/093 239/227
4,716,604 A * 1/1988 Watkins ..... A61H 33/6063 138/110
5,333,787 A * 8/1994 Smith ..... B05B 3/16 15/405
5,704,547 A * 1/1998 Golan et al. ..... 239/11
5,947,388 A * 9/1999 Woodruff ..... 239/532
6,860,435 B2 * 3/2005 Reid ..... 239/159
2007/0069402 A1 * 3/2007 Johnson ..... 257/E29.17

FOREIGN PATENT DOCUMENTS

JP 09-060874 A 3/1997
JP 10-286494 A 10/1998
JP 2010-046631 A 3/2010

OTHER PUBLICATIONS

Japanese Patent Office, International Search Report issued in Application No. PCT/JP2012/058075, mailed May 15, 2012, 2 pp.

* cited by examiner

*Primary Examiner* — Arthur O Hall
*Assistant Examiner* — Christopher R Dandridge
(74) *Attorney, Agent, or Firm* — Wood, Herron & Evans, LLP

(57) ABSTRACT

A swing nozzle (1) includes a base (11), a frame (12), the base end side of which is turnably supported on the base (11), a support body (13) which is supported on the leading end side of the frame (12) so as to be able to turn around a turning center axis parallel to a turning center axis of the frame (12) with respect to the base (11), and a pipe body (14) which is supported on the base (11) and the support body (13) in a state where a flexible section (50) between the base (11) and the support body (13) is bent and which discharges a fluid from an opening portion (56) of an opposite end to the base (11). According to the swing nozzle (1), it becomes possible to provide a swing nozzle in which it is possible to stably perform a swing movement in a plane.

2 Claims, 10 Drawing Sheets

SWING NOZZLE

TECHNICAL FIELD

The present invention relates to a swing nozzle.

Priority is claimed on Japanese Patent Application No. 2011-188638, filed Aug. 31, 2011, the content of which is incorporated herein by reference.

BACKGROUND ART

There is a fluid jetting nozzle which ejects a fluid through a side of an inner periphery having a tubular shape and jets the fluid and performs a swinging in a plane by forming a flat section having flexibility (refer to Patent Document 1, for example).

CITATION LIST

Patent Document

[Patent Document 1] Japanese Unexamined Patent Application, First Publication No. H10-286494

SUMMARY OF INVENTION

Technical Problem

In the fluid jetting nozzle described above, when the flow rate of the fluid passing through the inside increases, the flat section expands into a circular shape, and thus there is a possibility that a swing movement in a plane may become impossible.

Therefore, the present invention has an object to provide a swing nozzle in which it is possible to stably perform a swing movement in a plane.

Solution to Problem

In order to achieve the above object, according to a first aspect of the invention, there is provided a swing nozzle including: a base; a frame, the base end side of which is turnably supported on the base; a support body which is supported on the leading end side of the frame so as to be able to turn around a turning center axis parallel to a turning center axis of the frame with respect to the base; and a pipe body which is supported on the base and the support body in a state where a flexible section between the base and the support body is bent and which discharges a fluid from an opening portion of an opposite end to the base. Further, in the swing nozzle, when the frame is turned toward one side with respect to the base by a reactive force which is input from the pipe body to the support body at the time of fluid discharge and thus a bend state of the flexible section is reversed, the frame is turned to a turning end on one side by a biasing force of the flexible section, and when the frame is turned toward the other side with respect to the base by the reactive force and thus a bend state of the flexible section is reversed, the frame is turned to a turning end on the other side by the biasing force of the flexible section.

In a swing nozzle according to a second aspect of the invention, in the first aspect, a support position adjustment section capable of adjusting a support position of the pipe body is provided at the support body.

Advantageous Effects of Invention

According to the swing nozzle related to the first aspect of the invention, for example, in a state where the frame is inclined to one side with respect to the base, the flexible section of the pipe body bends, whereby a state is created where the opening portion side of the pipe body is inclined further to one side than the frame. In this state, a fluid is discharged from the opening portion of the pipe body, a reactive force directed to the other side is generated on the opening portion side of the pipe body, and the reactive force is transmitted from the support body supporting the pipe body to the frame, and thus the pipe body and the frame swing around the base toward the other side against the biasing force of the flexible section. Then, on the way, the bend state of the flexible section of the pipe body is reversed at a predetermined angle around the base, a state is created where the frame is instantaneously turned to a turning end on the other side with respect to the base by the biasing force of the flexible section, and a state is created where the opening portion side of the pipe body is inclined further to the other side than the frame. Then, a reactive force directed to one side is generated on the opening portion side of the pipe body, and the reactive force makes the pipe body and the frame swing toward one side against the biasing force of the flexible section. In this way, the pipe body oscillates in a reciprocating manner, that is, performs a swing movement. In this manner, since the pipe body is supported by the base which turnably supports the base end side of the frame, the frame, and the support body which is supported on the leading end side of the frame and a swing movement using the reactive force and the biasing force of the pipe body is performed, it is possible to stably perform a swing movement in a plane.

Furthermore, it is possible to make the opening portion of the pipe body oscillate in a reciprocating manner at a larger angle than the oscillation angle of the frame. Therefore, it is possible to more extensively discharge a fluid.

According to the swing nozzle related to the second aspect of the invention, when the support position of the pipe body is adjusted by the support position adjustment section provided at the support body, the length of the pipe body between the base and the support body, that is, the bend state of the flexible section can be adjusted, and as a result, it is possible to change a swinging angle.

DESCRIPTION OF EMBODIMENTS

A swing nozzle according to a first embodiment of the invention will be described below with reference to FIGS. 1 to 5.

Figure 1:
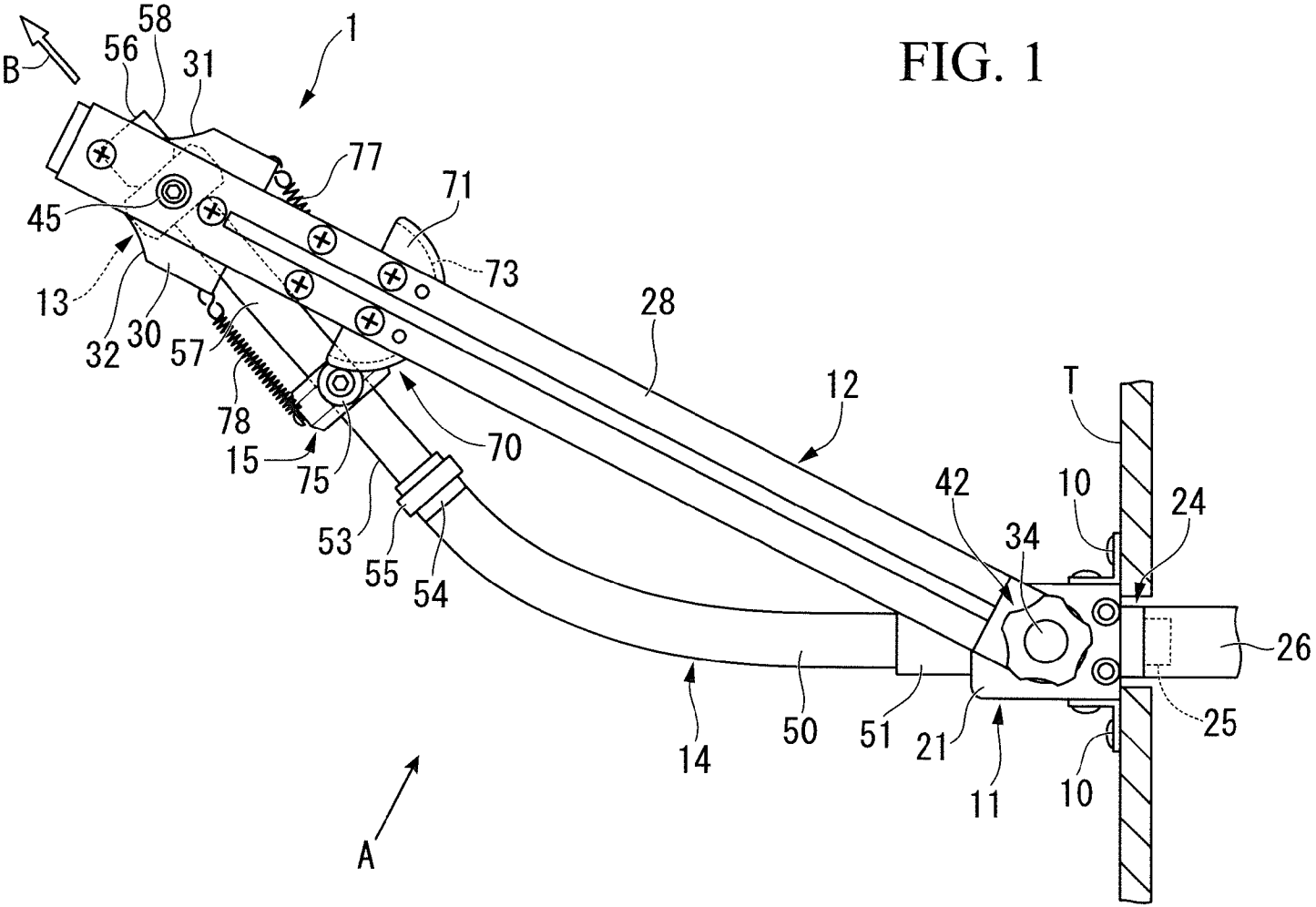
FIG. 1 is a plan view showing a swing nozzle according to a first embodiment of the invention in a state where the swing nozzle has swung to the rightmost side in the case of large amplitude.

As shown in FIG. 1, a swing nozzle 1 according to the first embodiment has a base 11 which is fixed to a mounting target section T such as a wall surface through a bracket 10, a frame 12, the base end side of which is supported on the base 11, a support body 13 which is supported on the leading end side of the frame 12, a pipe body 14 which is supported on the base 11 and the support body 13, and a moving body 15 which is provided at an intermediate position of the pipe body 14.

Figure 2:
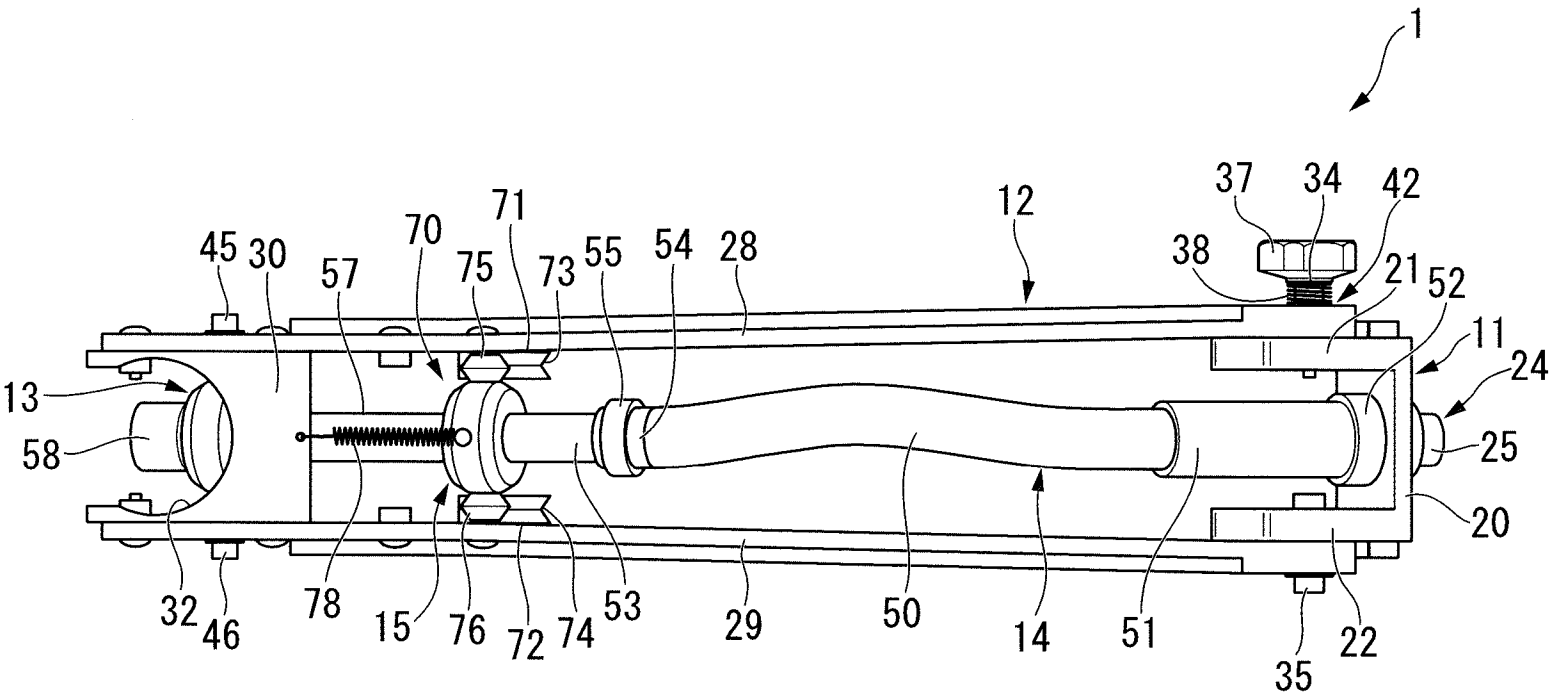
FIG. 2 is a view of the swing nozzle according to the first embodiment of the invention when viewed from a direction of an arrow A of FIG. 1.

The base 11 has a base plate section 20 having a rectangular plate shape, and a pair of support plate sections 21, 22 each having a rectangular plate shape and extending to the same side from opposite end edge portions of the base plate section 20 and perpendicular to the base plate section 20, as shown in FIG. 2, and forms a U-shape when viewed from the side. At the base plate section 20 of the base 11, a hose nipple 24 configuring a portion of the pipe body 14 is mounted to pass through the base plate section 20 in a plate thickness direction. The hose nipple 24 has a male thread portion 25 on the side opposite to the support plate sections 21, 22 of the base plate section 20 in a state of being mounted on the base 11, and the swing nozzle 1 is connected to piping 26 (shown in FIG. 1) on the fluid supply source side at the male thread portion 25.

The frame 12 has a pair of lengthy main plates 28, 29 each having a long shape, and a connection member 30 having a substantially cylindrical shape and connecting leading end portions of the main plates 28, 29 in a position along a central axis in the length directions of the main plates 28, 29, as shown in FIG. 2. On the leading end side of the connection member 30, notched portions 31, 32 are formed on both sides except for the connection portions connected to the main plates 28, 29, as shown in FIG. 1.

In the frame 12, as shown in FIG. 2, the base end side of the main plate 28 on one side is disposed outside the support plate section 21 on one side of the base 11, and in this state, the base end side of the main plate 28 is turnably supported by a turning shaft 34 having a threaded portion provided perpendicular to the support plate section 21. Further, the base end side of the main plate 29 on the other side is disposed outside the support plate section 22 on the other side of the base 11, and in this state, the base end side of the main plate 29 is turnably supported by a turning shaft 35 provided coaxially with the turning shaft 34 at the support plate section 22. In this way, the base end side of the frame 12 is supported on the base 11 so as to be able to turn with the turning shafts 34, 35 as a turning center axis.

A handle 37 is provided at the turning shaft 34 on one side, and a spring member 38 is provided between the handle 37 and the main plate 28. Further, a high-friction sheet (not shown) is interposed between the main plate 28 and the support plate section 21 of the base 11 close to the main plate 28. By adjusting the rotational position of the handle 37, the biasing force of the spring member 38 to the main plate 28 increases or decreases, and thus the frictional force of the main plate 28 against the high-friction sheet (not shown) increases or decreases. Therefore, the turning resistance of the frame 12 with respect to the base 11 increases or decreases. The handle 37, the spring member 38, and the high-friction sheet (not shown) configure an oscillation speed adjustment section 42 which adjusts an oscillation speed of the frame 12 with respect to the base 11, as will be described later.

Figure 3:
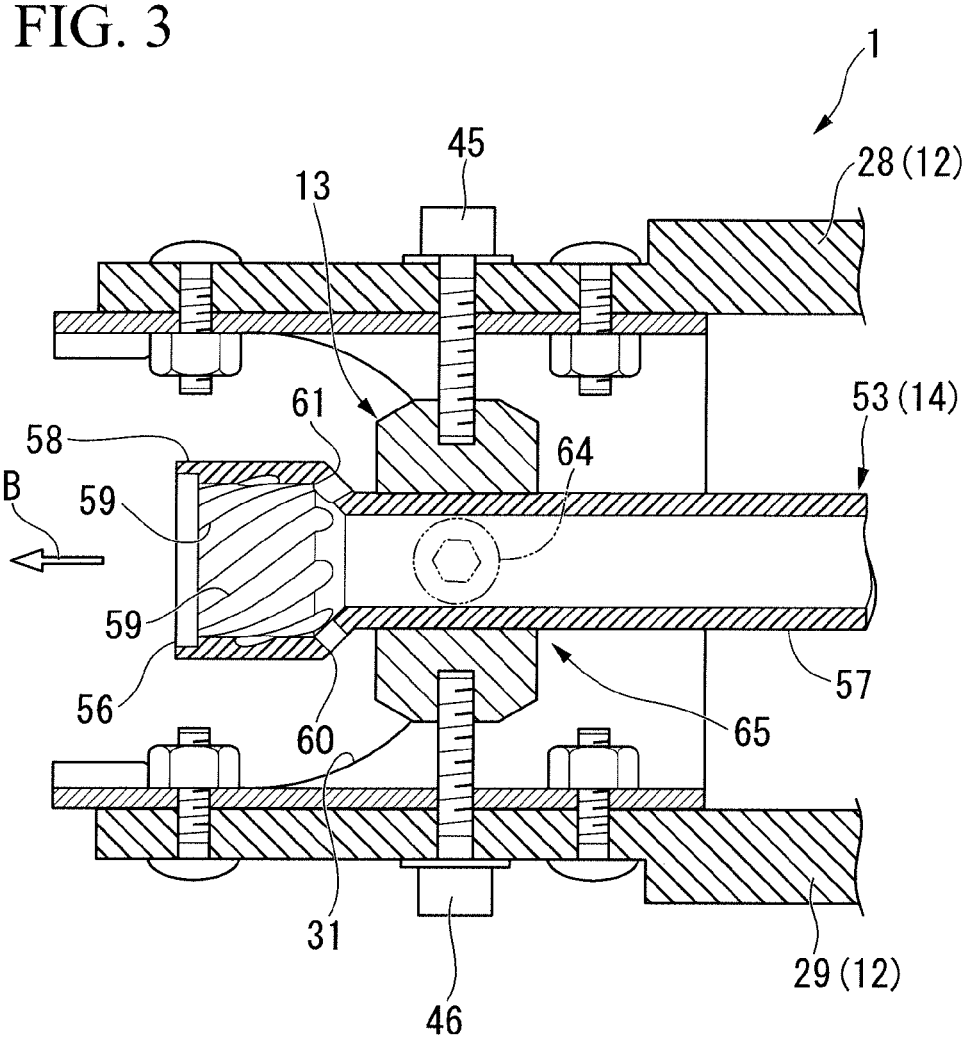
FIG. 3 is a partial cross-sectional side view of the swing nozzle according to the first embodiment of the invention.

The support body 13 has an annular shape and is disposed in the connection member 30. As shown in FIG. 3, the support body 13 is turnably supported by a turning shaft 45 vertically provided at a leading end of the main plate 28 on one side and a turning shaft 46 provided coaxially with the turning shaft 45 at the main plate 29 on the other side. In this way, the support body 13 is turnably supported on the leading end side of the frame 12. As shown in FIG. 2, the turning shafts 45, 46 are parallel to the turning shafts 34, 35 described above. That is, the turning center axis of the frame 12 with respect to the base 11 and the turning center axis of the support body 13 with respect to the frame 12 become parallel to each other. In other words, the support body 13 is supported on the leading end side of the frame 12 so as to be able to turn around a turning center axis parallel to the turning center axis of the frame 12 with respect to the base 11.

The pipe body 14 is configured to include the above-described hose nipple 24 which is fixed to the base 11, a mesh hose 50 (a flexible section), one end side of which is fitted to the side opposite to the male thread portion 25 of the hose nipple 24, a hose band 52 which fixes the mesh hose 50 to the hose nipple 24 through a protective tube 51 made of rubber, a pipe member 53 which is fitted to the other end side of the mesh hose 50, and a hose band 55 which fixes the mesh hose 50 to the pipe member 53 through a protective tube 54 made of rubber. Comparatively, while the mesh hose 50 is made of a material which is low in rigidity and has flexibility, the pipe member 53 is made of a material which is high in rigidity and has no flexibility. In addition, a material of the mesh hose 50, a structure of a connection section between the mesh hose 50 and the hose nipple 24, and a function of the protective tube 51 will be described in detail later.

As shown in FIG. 1, in the pipe body 14, an opening portion 56 is provided on an opposite end to the mesh hose 50 of the pipe member 53, that is, an opposite end to the base 11 of the pipe member 53, and a fluid introduced from the hose nipple 24 is discharged from the opening portion 56 in a direction shown by an arrow B. Here, as shown in FIG. 3, the pipe member 53 has a main cylindrical portion 57 having a constant diameter, and a large-diameter cylindrical portion 58 which forms the opening portion 56 in a larger diameter than the main cylindrical portion 57, and in the inner peripheral surface of the large-diameter cylindrical portion 58, a plurality of grooves 59 inclined with respect to an axis direction are formed at intervals in a circumferential direction. The base end sides of the grooves 59 are connected to a through-hole 61 which penetrates a step portion 60 between the large-diameter cylindrical portion 58 and the main cylindrical portion 57. Accordingly, when liquid is made to flow in the pipe member 53 as a fluid and discharged from the opening portion 56 in the direction of the arrow B, the outside air is sucked from the through-hole 61 and mixed with the liquid, and thus a swirl flow in a gas-liquid mixed state is created by the guidance of the grooves 59 and discharged.

The main cylindrical portion 57 of the pipe member 53 of the pipe body 14 is inserted into the inner periphery side of the support body 13. At this time, the large-diameter cylindrical portion 58 has a larger diameter than the inner diameter of the support body 13, and restricts the pipe member 53 to be come off the support body 13. In addition, a set screw 64 is screwed to the support body 13 along a radial direction, and when the set screw 64 advances to the center side of the support body 13, thereby coming into contact with the outer peripheral surface of the main cylindrical portion 57 of the pipe member 53, the pipe member 53 is fixed to the support body 13. On the other hand, the pipe member 53 is made to be able to move in an axial direction with respect to the support body 13 by separating the set screw 64 from the main cylindrical portion 57 of the pipe member 53. Accordingly, an inner peripheral portion of the support body 13 and the set screw 64 provided at the support body 13 configure a support position adjustment section 65 which enables adjustment of the support position of the pipe member 53 with respect to the support body 13. Here, as shown in FIG. 1, regardless of the support position of the support body 13, the length of the portion of the pipe body 14, which is disposed between the base 11 and the support body 13, is made to be longer than the distance between the base 11 and the support body 13, and in order to absorb the difference in length, the mesh hose 50 having flexibility is always curved. That is, the pipe body 14 is supported on the base 11 and the support body 13 in a state where the mesh hose 50 that is a flexible section between the base 11 and the support body 13 is bent.

The moving body 15 has an annular shape and allows the main cylindrical portion 57 which is near to the mesh hose 50 and further to the support body 13 of the pipe member 53 to be inserted into the inside. In this way, the moving body 15 is provided between the mesh hose 50 of the pipe body 14 and the support body 13 so as to be able to move along the pipe body 14, more specifically, to be able to slide on the main cylindrical portion 57 of the pipe member 53 of the pipe body 14.

Then, a guide mechanism 70 which guides the moving body 15 so as to be able to reciprocate in a direction crossing a direction connecting the base 11 and the support body 13, in other words, the length direction of the frame 12 is provided between the moving body 15 and the frame 12.

The guide mechanism 70 has a pair of cam plates 71, 72 which are respectively fixed to the inner sides of the pair of main plates 28, 29 of the frame 12, a pair of cam followers 75, 76 which are provided at the moving body 15 and move along cams 73, 74 of the cam plates 71, 72, and a pair of coil springs (biasing members) 77, 78 (shown in FIG. 1) which bias the moving body 15 in a direction bringing the cam followers 75, 76 into contact with the cams 73, 74, as shown in FIG. 2.

Figure 4:
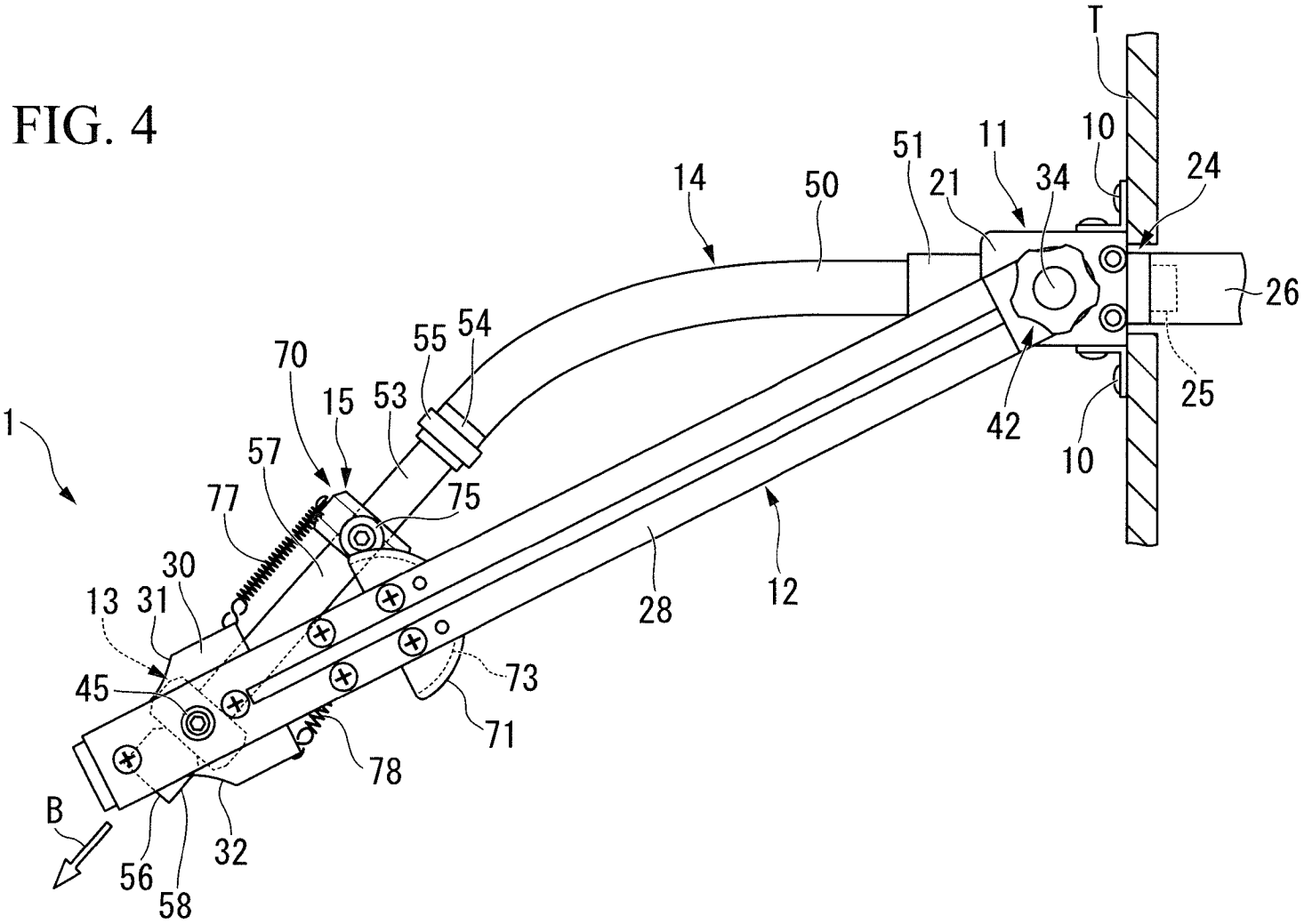
FIG. 4 is a plan view showing the swing nozzle according to the first embodiment of the invention in a state where the swing nozzle has swung to the leftmost side in the case of large amplitude.

Each of the pair of cams 73, 74 has an arc shape bulging toward the base 11, as shown for the cam 73 in FIG. 1, and has a V-shaped groove in which the center in a direction connecting the pair of main plates 28, 29 is deep, as shown in FIG. 2. Each of the pair of cam followers 75, 76 has a shape tapered in the opposite directions, which has a large diameter at the center position in the axial direction and is reduced in diameter as it goes to both sides in the axial direction, so as to be able to be fitted to the V-shaped groove of each of the pair of cams 73, 74. The pair of cam followers 75, 76 is fixed to the different positions by 180 degrees of an outer peripheral portion of the moving body 15 with the central axes being orthogonal to the moving body 15. One end of each of the pair of coil springs 77, 78 is connected to the position shifted by an angle of 90 degrees from each of the cam followers 75, 76 of the outer peripheral portion of the moving body 15 and the other end is connected to a proximity side of the position shifted by an angle of 90 degrees from each of the main plates 28, 29 of the connection member 30 of the frame 12, as shown in FIGS. 1, 4.

In the guide mechanism 70, the pair of cam followers 75, 76 provided at the moving body 15 respectively enter and come into contact with the V-shaped grooves of the pair of cams 73, 74, and in order for this state to be maintained, the moving body 15 is biased near to the support body 13, in other words, to the side opposite to the base 11 by the pair of coil springs 77, 78. Then, the moving body 15 moves while the axial movements of the pair of cam followers 75, 76 along the pair of cams 73, 74 are restricted, and accordingly, the guide mechanism 70 guides the moving body 15 so as to be able to reciprocate in a direction crossing the direction connecting the base 11 and the support body 13.

The pair of cams 73, 74 has an arc shape bulging near to the base 11, as described above, the center thereof in the width directions of the main plates 28, 29 of the frame 12 (that is, the center of the reciprocating movement of the moving body 15) is located closest to the base 11 in the length directions of the main plates 28, 29, and both sides thereof in the width directions of the main plates 28, 29 are curved so as to be located on the side opposite to the base 11 in the length directions of the main plates 28, 29 as it goes to the outward. Accordingly, the moving body 15 is biased to the sides opposite to the base 11 of the cams 73, 74 by the pair of coil springs 77, 78, whereby, when the moving body 15 is located on one side with respect to the center of the reciprocating movement, the guide mechanism 70 biases the moving body 15 so as to move to a movement end on one side, and when the moving body 15 is located on the other side with respect to the center of the reciprocating movement, the guide mechanism 70 biases the moving body 15 so as to move to a movement end on the other side.

When the swing nozzle 1 having the above configuration is mounted on the mounting target section T at the base 11 and liquid such as water which has been pumped is made to flow in the pipe body 14 which includes the hose nipple 24, the liquid is mixed with air which is sucked through the through-hole 61 and discharged from the opening portion 56 of the pipe member 53. At that time, a reactive force (a reaction force) is generated in the pipe member 53 of the pipe body 14, and the reactive force is transmitted from the support body 13 supporting the pipe member 53 to the frame 12 and thus a swing movement to make the pipe body 14 and the frame 12 supporting the pipe body 14 reciprocate in a plane with respect to the base 11 such that the states shown in FIGS. 1, 4 are alternated with each other is performed.

In this case, for example, in a state where the frame 12 is inclined to a turning end on one side with respect to the base 11, as shown in FIG. 1, the mesh hose 50 of the pipe body 14 is bent in a bow shape, whereby a state is created where the pipe member 53 which is supported on the support body 13 and the moving body 15 is inclined further to one side than the frame 12 and thus a state is created where the moving body 15 is located at a movement end on one side in a reciprocating direction. From this state, when the frame 12 is turned so as to be inclined to the opposite side with respect to the base 11 due to the reactive force described above, the frame 12 enters a state where it is also inclined to the opposite side with respect to the base 11 side of the mesh hose 50 of the pipe body 14, the inclination of the pipe member 53 with respect to the frame 12 is reduced depending on the length of the pipe body 14, and the cam followers 75, 76 of the moving body 15 provided at the pipe member 53 move on the cams 73, 74 to the center side of the reciprocating movement. Then, when the frame 12 is further inclined, the cam followers 75, 76 pass the center positions in the reciprocating directions of the cams 73, 74, whereby the moving body 15 is moved toward the other side in the reciprocating direction due to the biasing forces of the coil springs 77, 78. In addition, when the frame 12 is turned by a predetermined angle with respect to the base 11 and the bend state of the mesh hose 50 is reversed from convex shape to concave shape or vice versa, a state is created where the frame 12 is instantaneously turned and inclined to a turning end on the other side with respect to the base 11 by the biasing force (an elastic force), and the moving body 15 is moved to a movement end on the other side in the reciprocating direction. As a result, as shown in FIG. 4, a state is created where the pipe member 53 of the pipe body 14, which is supported on the support body 13 and the moving body 15, is inclined further to the opposite side than the frame 12. Such a swing movement by the discharge reactive force of the pumped fluid is repeatedly performed in a reciprocating manner, and the opening portion 56 oscillates in a reciprocating manner at a larger angle than the oscillation angle of the frame 12. In addition, the cutout portions 31, 32 described above are formed in the connection member 30 of the frame 12 such that interference with the oscillation of the pipe member 53 does not occur.

Here, when the contact pressure of the base 11 and the frame 12 with the high-friction sheet (not shown) is increased by operating the handle 37 of the oscillation speed adjustment section 42 described above, frictional resistance increases and thus the movement speed of the above-described swing movement becomes slow, and conversely, when the contact pressure of the base 11 and the frame 12 with the high-friction sheet (not shown) is decreased, the frictional resistance decreases and thus the movement speed of the above-described swing movement becomes fast.

Figure 5:
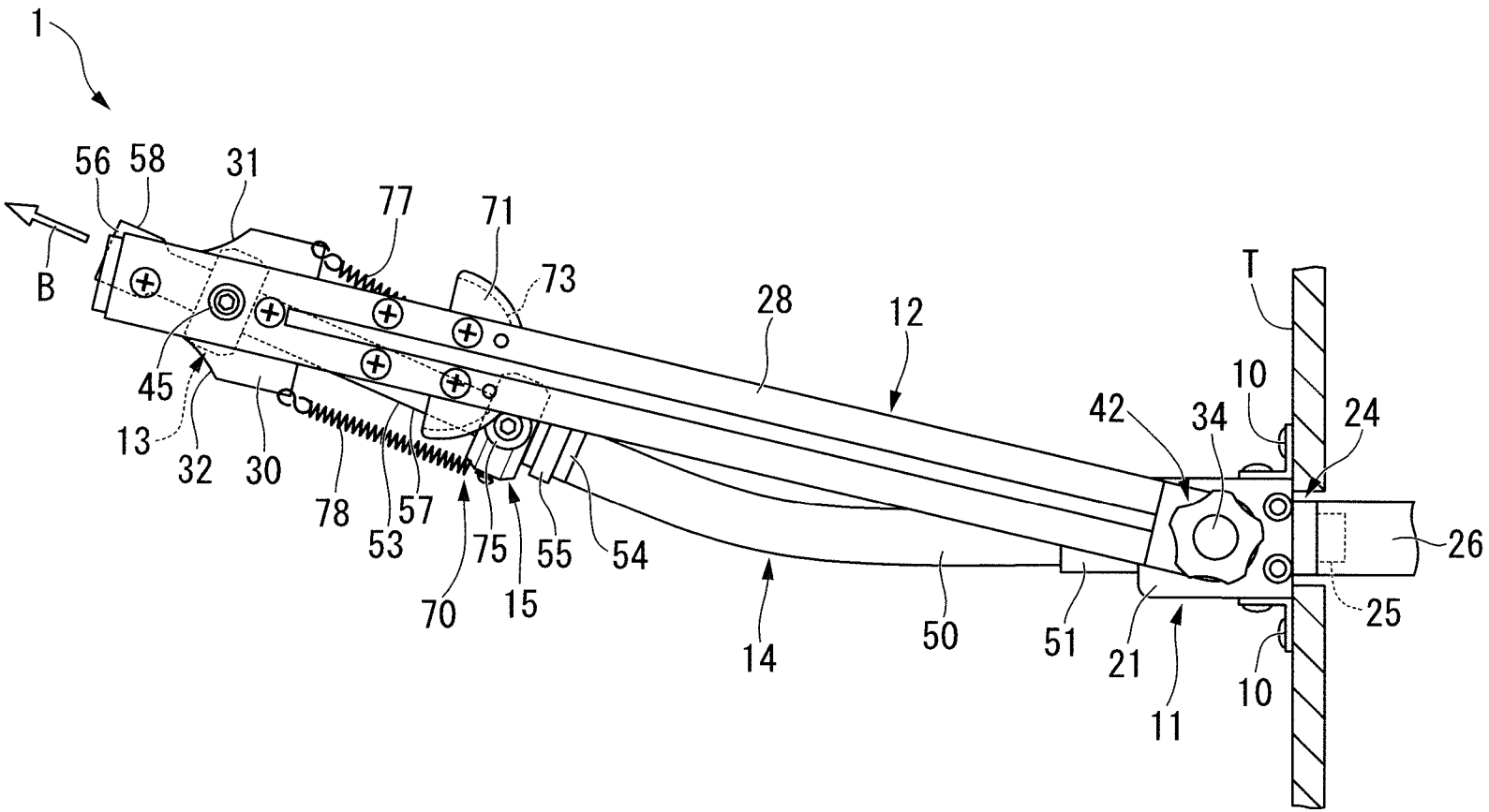
FIG. 5 is a plan view showing the swing nozzle according to the first embodiment of the invention in a state where the swing nozzle has swung to the rightmost side in the case of small amplitude.

Further, when the support position of the pipe member 53 on the support body 13 is adjusted by the support position adjustment section 65 described above and, for example, the length of the pipe body 14 between the base 11 and the support body 13 is increased, as shown in FIGS. 1, 4, the oscillation angle of the swing movement becomes large, and when the length of the pipe body 14 between the base 11 and the support body 13 is reduced, as shown in FIG. 5, the oscillation angle of the swing movement becomes small. In this way, it is possible to adjust a discharge range of a fluid.

In addition, the support position adjustment section 65 may adjust the support position of the pipe body 14 on the base 11 besides adjusting the support position of the pipe body 14 on the support body 13. That is, when the length of the pipe body 14 between the base 11 and the support body 13 can be adjusted, a support position adjustment section capable of adjusting the support position of the pipe body 14 may be provided in at least one of the support body 13 and the base 11.

According to the swing nozzle 1 related to the first embodiment described above, since the pipe body 14 is supported by the base 11 which turnably supports the base end side of the frame 12, the frame 12, and the support body 13 which is supported on the leading end side of the frame 12 and the swing movement is performed, for example, even if the flow rate of a fluid passing through the inside is increased, it is possible to stably perform the swing movement in a plane.

Furthermore, since by providing the guide mechanism 70, it is possible to make the opening portion 56 of the pipe body 14 perform a swing movement at a larger angle than the oscillation angle of the frame 12, it is possible to more extensively discharge a fluid.

Further, when the moving body 15 is located on one side with respect to the center of the reciprocating movement, the moving body 15 can be biased by the guide mechanism 70 having a simple structure so as to move to the movement end on one side, and when the moving body 15 is located on the other side with respect to the center of the reciprocating movement, the moving body 15 can be biased by the guide mechanism 70 so as to move to the movement end on the other side.

Further, when the support position of the pipe body 14 by the support body 13 is adjusted by the support position adjustment section 65 provided at the support body 13, the length of the pipe body 14 between the base 11 and the support body 13 can be adjusted, and as a result, it is possible to change the swinging angle of the swing nozzle 1.

In addition, a portion on the opening portion 56 side of the pipe member 53 may be made to be a separate member and the different kinds of members having different bore diameters may be prepared and changed depending on the usage.

Further, a flexible tube which is thinner than the pipe body 14 described above may be disposed in the pipe body 14 so as to be opened in the vicinity of the opening portion 56 through the pipe body 14. Then, when one type of liquid is pumped between the pipe body 14 and the thin tube and discharged from the opening portion 56, the swing nozzle 1 discharges one type of liquid while performing a swing operation, as described above. However, at this time, because of a base end of the thin tube is inserted into another type of liquid, pressure in the vicinity of a leading end of the thin tube becomes negative by the principle of an ejector due to the discharge of one type of liquid, and thus another type of liquid is sucked up from the tube and discharged together. In this way, it is possible to discharge two types of liquid in a mixed state. In this case, for example, when water is used as one type of liquid and a detergent is used as another type of liquid, the detergent can be diluted with the water and discharged with making bubbles by being mixed with the outside air from the through-hole 61.

The swing nozzle 1 according to the first embodiment described above has a base, a frame, the base end side of which is turnably supported on the base, a support body which is turnably supported on the leading end side of the frame, a pipe body which has a flexible section, is supported on the base and the support body, and discharges a fluid from an opening portion of an opposite end to the base, a moving body which is provided between the flexible section of the pipe body and the support body so as to be able to move along the pipe body, and a guide mechanism which guides the moving body so as to be able to reciprocate in a direction crossing with a direction connecting the base and the support body, and when the moving body is located on one side with respect to the center of a reciprocating movement, the guide mechanism biases the moving body so as to move to a movement end on one side, and when the moving body is located on the other side with respect to the center of the reciprocating movement, the guide mechanism biases the moving body so as to move to a movement end on the other side.

Accordingly, when a fluid is discharged from the opening portion of the pipe body, a reactive force is generated on the opening portion side of the pipe body, and the reactive force is transmitted from the support body supporting the pipe body to the frame, whereby the pipe body and the frame oscillate in a reciprocating manner with respect to the base, that is, perform a swing movement with respect to the base. In this manner, since the pipe body is supported by the base which turnably supports the base end side of the frame, the frame, and the support body which is supported on the leading end side of the frame and a swing movement using the reactive force of the pipe body is performed, it is possible to stably perform a swing movement in a plane.

Furthermore, for example, in a state where the frame is inclined to one side with respect to the base, the portion of the pipe body between the support body and the moving body is inclined further to one side than the frame and the moving body is located at the movement end on one side in the reciprocating direction, when the frame is turned by the above-described reactive force so as to be inclined to the opposite side with respect to the base, the frame is also inclined to the opposite side with respect to the base end side of the pipe body, and accordingly, the moving body provided at the pipe body moves to the center side of the reciprocating movement. Then, when the moving body passes the center, the moving body is moved to the other side of the movement end in the reciprocating direction by the biasing force of the guide mechanism and the portion of the pipe body between the support body and the moving body is inclined to the opposite side at a larger angle than the frame. By performing such an operation in a reciprocating manner, it is possible to make the opening portion of the pipe body oscillate in a reciprocating manner at a larger angle than the oscillation angle of the frame. Therefore, it is possible to more extensively discharge a fluid.

That is, with this swing nozzle, a forward movement in which, when the frame is turned toward one side with respect to the base by a discharge reactive force which is input from the pipe body to the support body at the time of fluid discharge and thus the bend state of the flexible section is reversed, the frame is turned to the turning end on one side by the biasing force of the flexible section, and a return movement in which, when the frame is turned toward the other side with respect to the base by the discharge reactive force and thus the bend state of the flexible section is reversed, the frame is turned to the turning end on the other side by the biasing force of the flexible section, are alternately repeated with only a fluid flowing through the pipe body as a drive source. As a result, a swing movement is performed automatically and at low cost with only the flow of a fluid that is essential for the discharge of a fluid as a power source, and it is possible to extensively discharge a fluid.

Further, in the first embodiment, the guide mechanism has a cam which is fixed to the frame and has an arc shape bulging toward the base, a cam follower which is provided at the moving body and moves along the cam, and a biasing member which biases the moving body in a direction bringing the cam follower into contact with the cam.

As a result, when the moving body is located on one side with respect to the center of the reciprocating movement, the moving body can be biased by the guide mechanism having a simple structure so as to move to the movement end on one side, and when the moving body is located on the other side with respect to the center of the reciprocating movement, the moving body can be biased by the guide mechanism so as to move to the movement end on the other side.

Next, a swing nozzle according to a second embodiment of the invention will be described with reference to FIGS. 6 to 9.

Figure 6:
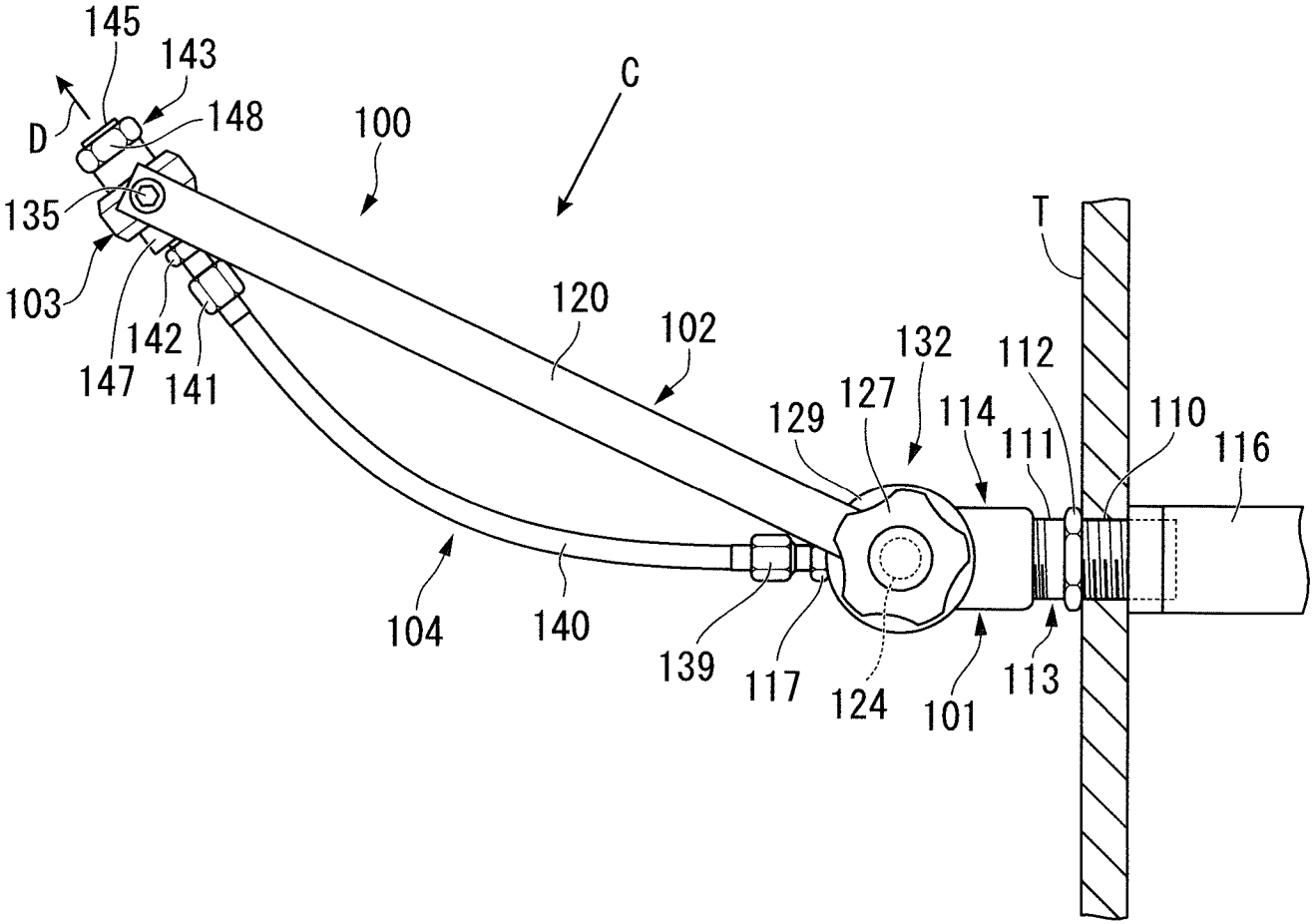
FIG. 6 is a plan view showing a swing nozzle according to a second embodiment of the invention in a state where the swing nozzle has swung to the rightmost side in the case of medium amplitude.

As shown in FIG. 6, a swing nozzle 100 according to the second embodiment has a base 101 which is fixed to the mounting target section T such as a wall surface, a frame 102, the base end side of which is supported on the base 101, a support body 103 which is supported on the leading end side of the frame 102, and a pipe body 104 which is supported on the base 101 and the support body 103.

The base 101 is configured to include a connector 113 in which male threads 110, 111 are formed at both end portions and a hexagonally-shaped portion 112 is formed at an intermediate portion, and a base main body 114 which has a bottomed cylindrical shape and is screwed on the male thread 111 of one end of the connector 113. The base 101 is fixed to the mounting target section T at the male thread 110 of the other end of the connector 113 and connected to piping 116 on the fluid supply source side.

A hose nipple 117 configuring a portion of the pipe body 104 is mounted on a bottom portion of the base main body 114.

Figure 7:
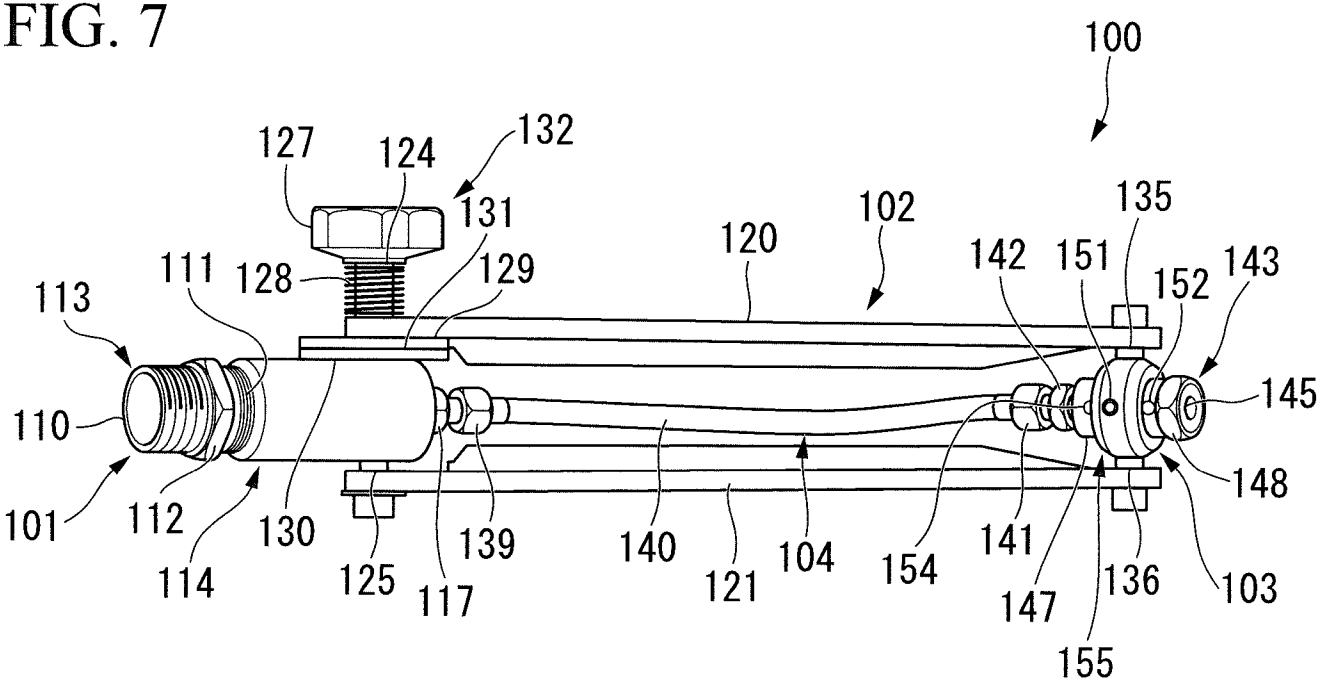
FIG. 7 is a view of the swing nozzle according to the second embodiment of the invention in a view from a direction of an arrow C of FIG. 6.

The frame 102 is configured to have a pair of lengthy frame members 120, 121, as shown in FIG. 7. In the frame 102, the base end side of the frame member 120 on one side is disposed on one side in a radial direction of the base main body 114, and in this state, the base end side of the frame member 120 is turnably supported by a turning shaft 124 connected to the base main body 114. Further, the base end side of the frame member 121 on the other side is disposed on the side opposite to the frame member 120 of the base main body 114, and in this state, the base end side of the frame member 121 is turnably supported by a turning shaft 125 provided coaxially with the turning shaft 124. In this way, the base end side of the frame 102 is supported on the base main body 114 of the base 101 so as to be able to turn with the centers of the turning shafts 124, 125 as a turning center axis.

A handle 127 is provided at the turning shaft 124 on one side, and a spring member 128 is provided between the handle 127 and the frame member 120. Further, a circular plate 129, a circular plate 130, and a high-friction sheet 131 are provided between the frame member 120 and the base 101. The circular plate 129, the circular plate 130, and the high-friction sheet 131 have disk shapes having the same diameter and the turning shaft 124 is disposed at the centers thereof. The circular plate 129 is fixed to the frame member 120, the circular plate 130 is fixed to the base main body 114, and the high-friction sheet 131 is interposed between the circular plates 129, 130. By adjusting the rotational position of the handle 127, the distance between the handle 127 and the frame member 120 is changed, and accordingly, the biasing force of the spring member 128 to the frame member 120 increases or decreases, and thus the frictional forces between the circular plates 129, 130 and the high-friction sheet 131 increases or decreases. In this way, the turning resistance of the frame 102 with respect to the base 101 increases or decreases. That is, the handle 127, the spring member 128, the circular plates 129, 130, and the high-friction sheet 131 configure an oscillation speed adjustment section 132 which adjusts an oscillation speed of the frame 102 with respect to the base 101, as will be described later.

The support body 103 has an annular shape and is turnably supported by a turning shaft 135 provided at a leading end of the frame member 120 on one side and a turning shaft 136 provided at the frame member 121 on the other side coaxially with the turning shaft 135. In this way, the support body 103 is turnably supported on the leading end side of the frame 102. The turning shafts 135, 136 are parallel to the turning shafts 124, 125 described above. That is, the turning center of the frame 102 with respect to the base 101 and the turning center of the support body 103 with respect to the frame 102 become parallel to each other. In other words, the support body 103 is supported on the leading end side of the frame 102 so as to be able to turn around a turning center axis parallel to the turning center axis of the frame 102 with respect to the base 101.

In addition, in a case where the turning shafts 135, 136 are made of metal, the frame members 120, 121 coming into contact with the turning shafts 135, 136 may be made of a material different from those of the turning shafts 135, 136, for example, resin such as nylon. The frame members 120, 121 are made of resin, whereby the weight of especially the leading end side of the swing nozzle 100 is reduced, and as a result, a centrifugal force and inertia which are applied to the swing nozzle 100 at the time of a swing movement are reduced. Further, by configuring the turning shafts 135, 136 and the frame members 120, 121 by using different types of materials, abrasion of the two is reduced. In particular, when the frame members 120, 121 are made of resin, the abrasion is further reduced due to a self-lubricating property that the resin has.

The pipe body 104 is configured to include the above-described hose nipple 117 which is connected to the base main body 114 of the base 101 at one end side, a flexible tube 140 (a flexible section), one end portion of which is connected to the other end side of the hose nipple 117 through a nut member 139, a hose nipple 142 which is connected to the other end portion of the tube 140 through a nut member 141, and a pipe member 143 which is connected to the hose nipple 142. Comparatively, while the tube 140 is made of, for example, a synthetic resin material which is low in rigidity and has flexibility, the pipe member 143 is made of, for example, the same metal material as that in the first embodiment, which is high in rigidity and has no flexibility. In addition, a material of the tube 140 and a structure of a connection section between the tube 140 and the hose nipple 117 will be described in detail later.

An opening member (an opening portion) 145 having a tubular shape is screwed on an opposite end to the tube 140 of the pipe member 143, that is, an opposite end to the base 101 of the pipe member 143, and the opening member 145 forms an opening portion of the pipe body 104. The pipe body 104 discharges a fluid introduced into the hose nipple 117 through the base 101, from the opening member 145 in a direction shown by an arrow D in FIG. 6. The discharge flow rate or the discharge distance of a fluid from the pipe body 104 can be adjusted by preparing plural kinds of opening members 145 having different inner diameters and selectively mounting the opening members 145 on the pipe member 143.

The pipe member 143 has a main cylindrical portion 147 which has a constant diameter and is connected to the hose nipple 142 at one end side, and a hexagonally-shaped portion 148 formed on the other end side of the main cylindrical portion 147, and the opening member 145 is screwed on the hexagonally-shaped portion 148 side of the axial direction.

The pipe body 104 is inserted into the inner periphery side of the support body 103 at the main cylindrical portion 147 of the pipe member 143. At this time, the hexagonally-shaped portion 148 is larger than the inner diameter of the support body 103 and thus coming-off of the pipe member 143 from the support body 103 is restricted. In addition, as shown in FIG. 7, a set screw 151 is screwed to the support body 103 along the radial direction, and in the main cylindrical portion 147 of the pipe member 143, a plurality of concave portions 152 to 154 shown in FIGS. 8A to 8C, to which a leading end portion of the set screw 151 is fitted, are formed side by side in series in the axial direction.

When the set screw 151 is rotated, thereby being separated from the main cylindrical portion 147 of the pipe member 143, the pipe member 143 becomes movable in the axial direction with respect to the support body 103. Further, when the set screw 151 is selectively aligned with the plurality of concave portions 152 to 154 and advanced to the center side of the support body 103, thereby being fitted to a corresponding concave portion of the concave portions 152 to 154, the pipe member 143 is fixed to the support body 103 at a position corresponding to the fitted concave portion of the concave portions 152 to 154. Accordingly, the support body 103, the set screw 151 provided at the support body 103, and the plurality of concave portions 152 to 154 of the pipe member 143 form a support position adjustment section 155 which enables adjustment of the support position of the pipe member 143 with respect to the support body 103. Here, regardless of the support position of the support body 103, the length of the portion of the pipe body 104, which is disposed between the base 101 and the support body 103, is made longer than the distance between the base 101 and the support body 103, similar to the first embodiment, as shown in, for example, FIG. 6, and in order to absorb the difference in length, the tube 140 having flexibility is always bent in a curved shape. That is, the pipe body 104 is supported on the base 101 and the support body 103 in a state where the tube 140 that is a flexible section between the base 101 and the support body 103 is bent.

Figure 9:
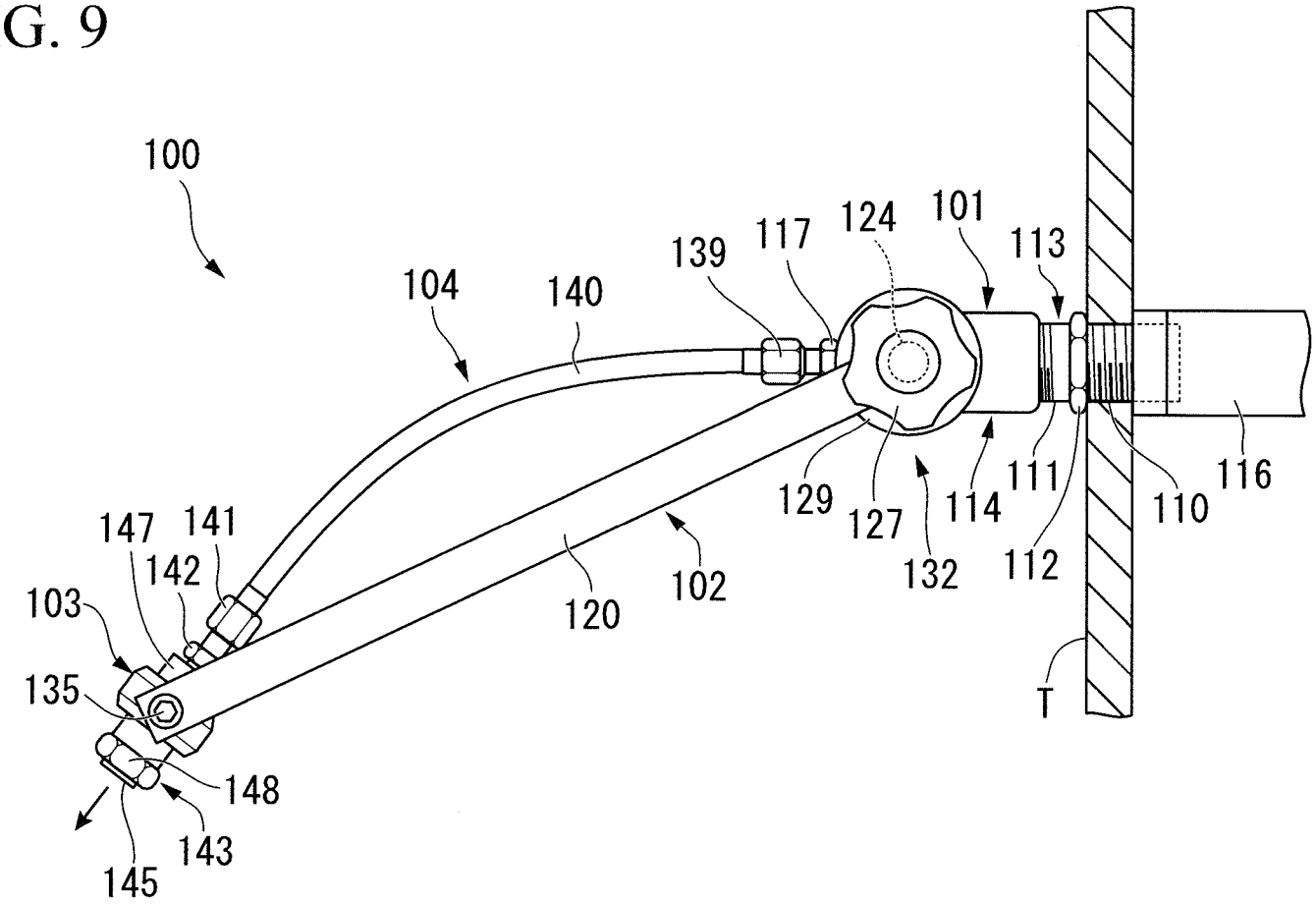
FIG. 9 is a plan view showing the swing nozzle according to the second embodiment of the invention in a state where the swing nozzle has swung to the leftmost side in the case of medium amplitude.

When the swing nozzle 100 having the configuration described above is mounted on the mounting target section T at the male thread 110 of the base 101 and liquid such as water which has been pumped is made to flow from the base 101 into the pipe body 104, the liquid is discharged from the opening member 145 of the pipe member 143. At that time, a reactive force is generated in a direction opposite to a discharge direction in the pipe member 143 of the pipe body 104, and the reactive force is transmitted from the support body 103 supporting the pipe member 143 to the frame 102 and thus a swing movement to make the pipe body 104 and the frame 102 supporting the pipe body 104 reciprocate in a plane with respect to the base 101 such that the states shown in FIGS. 6, 9 are alternated with each other is performed.

At that time, for example, in a state where the frame 102 is inclined to one side with respect to the base 101, as shown in FIG. 6, the tube 140 of the pipe body 104 is bent in a bow shape, whereby a state is created where the opening member 145 side of the pipe body 104 is inclined further to one side than the frame 102. In this state, when liquid is discharged from the opening member 145 of the pipe body 104, a reactive force directed to the other side is generated on the opening member 145 side of the pipe body 104. The reactive force which is generated at the time of the liquid discharge is input from the pipe body 104 to the support body 103 supporting the pipe body 104 and transmitted from the support body 103 to the frame 102, and as a result, the pipe body 104 and the frame 102 swing around the base 101 toward the other side against the biasing force of the tube 140. Then, when the frame 102 is turned by a predetermined angle toward the other side with respect to the base 101 and the bend state of the tube 140 of the pipe body 104 is reversed from convex shape to concave shape or vice versa, a state is created where the frame 102 is instantaneously turned and inclined to a turning end on the other side with respect to the base 101 by the biasing force of the tube 140, as shown in FIG. 9, and a state is created where the opening member 145 side of the pipe body 104 is inclined further to the other side than the frame 102. Then, a reactive force directed to one side is generated on the opening member 145 side of the pipe body 104, and the reactive force is input from the pipe body 104 to the support body 103 and transmitted from the support body 103 to the frame 102, and as a result, the pipe body 104 and the frame 102 swing around the base 101 toward one side against the biasing force of the tube 140. Then, when the frame 102 is turned by a predetermined angle toward one side with respect to the base 101 and the bend state of the tube 140 of the pipe body 104 is reversed, a state is created where the frame 102 is instantaneously turned and inclined to a turning end on one side with respect to the base 101 by the biasing force of the tube 140, as shown in FIG. 6, and a state is created where the opening member 145 side of the pipe body 104 is inclined further to one side than the frame 102. Such a swing movement by the discharge reactive force of the pumped liquid is repeatedly performed in a reciprocating manner, and the opening member 145 oscillates in a reciprocating manner, that is, performs a swing movement, at a larger angle than the oscillation angle of the frame 102.

Here, when the contact pressure of the circular plates 129, 130 with the high-friction sheet 131 is increased by operating the handle 127 of the oscillation speed adjustment section 132 described above, frictional resistance increases and thus the movement speed of the above-described swing movement becomes slow, and conversely, when the contact pressure of the circular plates 129, 130 with the high-friction sheet 131 is decreased, the frictional resistance decreases and thus the movement speed of the above-described swing movement becomes fast.

Figure 8A:
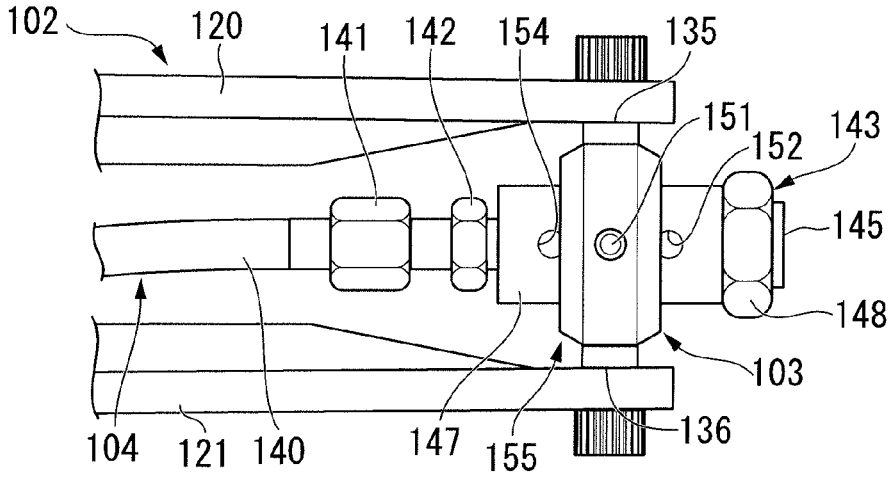
FIG. 8A is a partial side view showing a support position adjustment section and the like of the swing nozzle according to the second embodiment of the invention and shows in the case of middle amplitude.
Figure 8B:
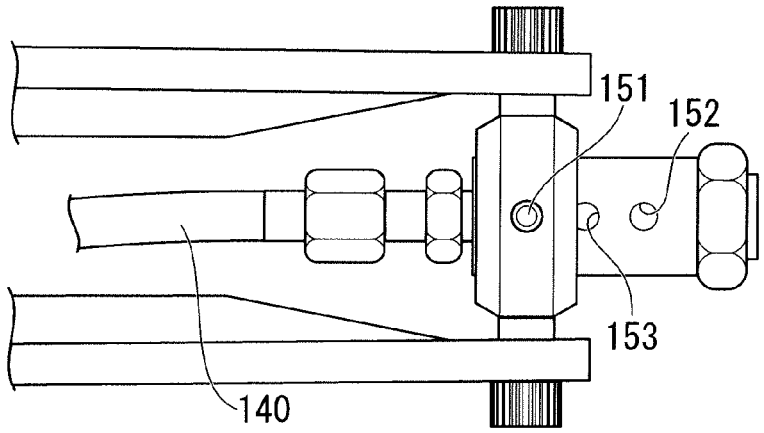
FIG. 8B is a partial side view showing the support position adjustment section and the like of the swing nozzle according to the second embodiment of the invention and shows in the case of small amplitude.
Figure 8C:
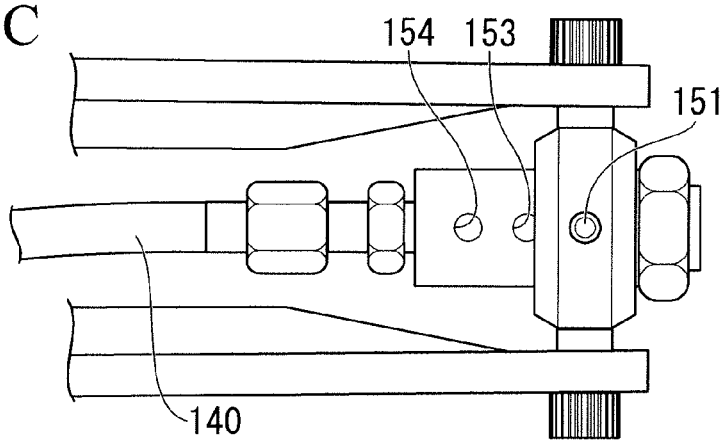
FIG. 8C is a partial side view showing the support position adjustment section and the like of the swing nozzle according to the second embodiment of the invention and shows in the case of large amplitude.

Further, when the support position of the pipe member 143 on the support body 103 is adjusted by the support position adjustment section 155 described above and, for example, the set screw 151 is fitted into the intermediate concave portion 153, as shown in FIG. 8A, thereby making the length of the pipe body 104 between the base 101 and the support body 103 be a middle length, the oscillation angle of the swing movement becomes middle, and if the set screw 151 is fitted into the concave portion 154 on the tube 140 side, as shown in FIG. 8B, thereby making the length of the pipe body 104 between the base 101 and the support body 103 short, the oscillation angle of the swing movement becomes small, and if the set screw 151 is fitted into the concave portion 152 on the side opposite to the tube 140, as shown in FIG. 8C, thereby making the length of the pipe body 104 between the base 101 and the support body 103 long, the oscillation angle of the swing movement becomes large. In this way, it is possible to adjust a discharge range of liquid.

In addition, also in this case, the support position adjustment section 155 may adjust the support position of the pipe body 104 on the base 101 besides adjusting the support position of the pipe body 104 on the support body 103. That is, when the length of the pipe body 104 between the base 101 and the support body 103 can be adjusted, a support position adjustment section capable of adjusting the support position of the pipe body 104 may be provided in at least one of the support body 103 and the base 101.

According to the swing nozzle 100 related to the second embodiment described above, in addition to the operation and effects of the first embodiment described above, since the pipe body 104 is supported by the base 101 which turnably supports the base end side of the frame 102, the frame 102, and the support body 103 which is supported on the leading end side of the frame 102 and a swing movement is performed by a toggle mechanistic structure using the reactive force of the pipe body 104 at the time of liquid discharge and a biasing force (a repulsive force) which is generated by the deformation of the tube 140, for example, even if the flow rate of a fluid passing though the inside is increased, it is possible to stably perform a swing movement in a plane.

Furthermore, it is possible to make the opening member 145 of the pipe body 104 oscillate in a reciprocating manner at a larger angle than the oscillation angle of the frame 102. Therefore, it is possible to more extensively discharge a fluid.

Further, since a swing movement is performed with a balance between the reactive force of the pipe body 104 at the time of fluid discharge and a biasing force which is generated by the deformation of the tube 140, without providing the guide mechanism 70 in the first embodiment, the number of components is reduced and thus it is possible to significantly reduce the cost.

Further, the length of the pipe body 104 between the base 101 and the support body 103 can be adjusted by adjusting the support position of the pipe body 104 by the support body 103 by the support position adjustment section 155 provided at the support body 103, and as a result, it is possible to change the swinging angle of the swing nozzle 100.

Further, since different types of opening members 145 having different inner bore diameters are changed depending on a use, it is possible to change a discharge flow rate or a discharge distance.

In addition, when the same through-hole as the through-hole 61 for air intake in the first embodiment is formed in the pipe member 143, when liquid is made to flow in the tube 140 and discharged from the opening member 145 of the pipe member 143, the outside air is sucked from the through-hole and mixed with the liquid, whereby the liquid is discharged in a gas-liquid mixed state. Further, in addition to this, a flexible tube which is thinner than the pipe body 104 described above may be disposed to be connected to the tube 140 so as to be opened in the vicinity of the opening member 145.

Next, as the configuration which is common to the first and second embodiments, materials of the flexible sections of the pipe bodies 14, 104 and a structure of a connection section between the flexible section and the hose nipple 24 or 117 will be described below.

In the above embodiments, the mesh hose 50 or the tube 140 is used as the flexible section. These flexible sections need to have predetermined pressure resistance in terms of its function, referred to as the pumping of liquid. The required pressure resistance is in a range of about 1 MPa to about 30 MPa. As a material having such flexibility and pressure resistance, in a case where a tube as denoted by reference numeral 140 is used for the flexible section, for example, polyurethane, nylon, fluorine resin (Teflon (registered trademark)), or the like is used. Further, in a case where a mesh hose as denoted by reference numeral 50 is used, a hose having a three-layer structure is used in which the circumference of a resin tube made of, for example, nylon or the like is covered with a mesh knitted by using fibers such as aramid fibers (Kevlar (registered trademark)), for example, and further covered with a tube made of resin. By using the mesh hose, it is possible to prevent unnecessary expansion of a tube which is located at the innermost layer, while maintaining desired flexibility.

Further, with regard to the structure of the connection section between the flexible section and the hose nipple 24 or 117, from the viewpoint of the pressure resistance of the connection section, connection by a nut member as denoted by reference numeral 139 in, for example, FIG. 7 is preferable. However, in a case of being used in relatively low pressure, a joint 200 extending from the hose nipple 117 may be press-fitted and connected to the tube (the flexible section) 140, as shown in, for example, FIG. 10. In this case, a predetermined range toward the other end side (the right side in the drawing) from the portion (one end side; the left side in the drawing) to which the joint 200 is press-fitted, of the tube 140, may be further covered with an outer tube 201 having flexibility.

By further covering one end side of the tube 140 with the outer tube 201, one end side of the tube 140 is supported from the circumference by the outer tube 201. As a result, even in a case where pressure is applied to a connection section between the tube 140 and the joint 200 due to the pumping of liquid to the tube 140, coming-off of the tube 140 from the joint 200 is prevented. Further, an extreme bend in one end portion of the tube 140 associated with the swing movement of the nozzle is prevented by the outer tube 201 and a swing width of the tube 140 is controlled within a proper range. In addition, concentration of stress in the contact site (a site denoted by an arrow P in FIG. 10) with a leading end of the joint 200 of the tube 140 associated with an extreme bend of the tube 140 is prevented and thus the durability of the tube 140 is improved.

Figure 10:
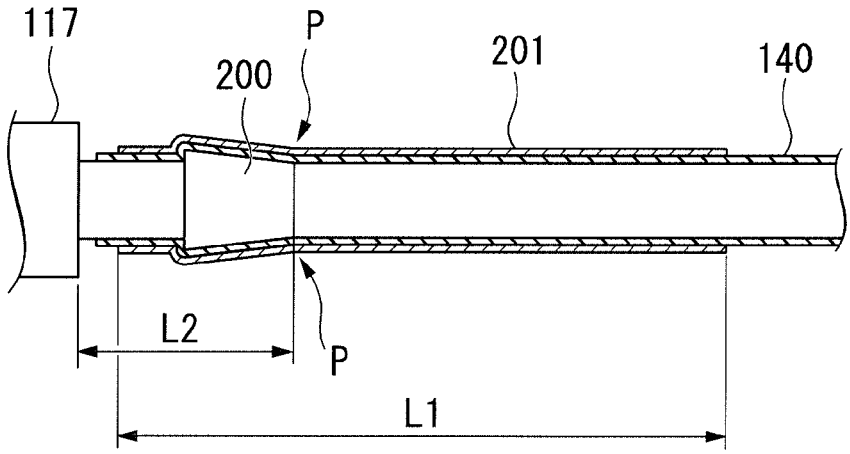
FIG. 10 is a partial cross-sectional view of a connection section between a tube and a hose nipple, showing a modified example of the swing nozzle according to the invention.
Figure 11:
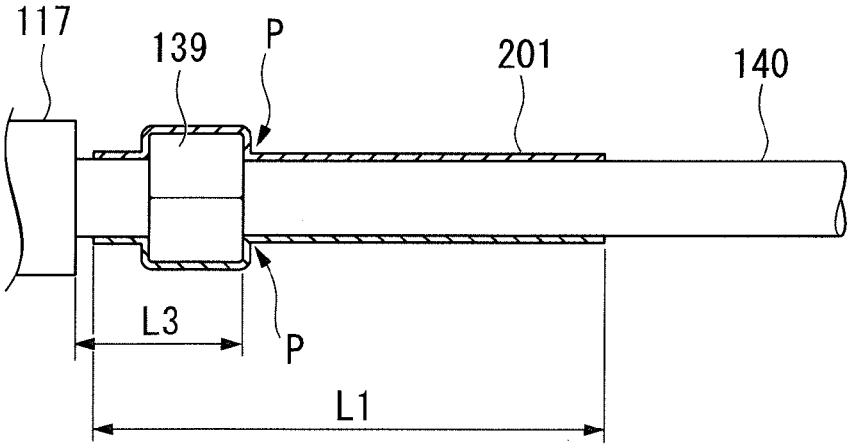
FIG. 11 is a partial cross-sectional view of the connection section between the tube and the hose nipple, showing a modified example of the swing nozzle according to the invention.

As shown in, for example, FIG. 11, also in a case where the hose nipple 117 and the tube 140 are connected by the nut member 139, the above-described effect is obtained by further covering a predetermined range toward the other end side (the right side in the drawing) from the connection site (one end side; the left side in the drawing) with the nut member 139 of the tube 140 with the outer tube 201. In addition, a site denoted by an arrow P in FIG. 11 is the contact site with a leading end of the nut member 139 of the tube 140. Similar to the case of FIG. 10, since also in the site P, concentration of stress is prevented by the outer tube 201, the durability of the tube 140 is improved. In these cases, in order to obtain the above-described effect, it is preferable to make a full length L1 of the outer tube 201 be in a range of two to four times the full length of the site which is used for connection with the tube 140, of the hose nipple 117, that is, a full length L2 of the joint 200 or a length L3 from a leading end of the hose nipple 117 to a leading end of the nut member 139. In addition, further preferably, the full length L1 is set to be in a range of 2.5 to 3.5 times the full length L2 or the length L3.

In addition, in FIGS. 10, 11, a case where the outer tube 201 is applied to the second embodiment of the invention has been described. However, of course, it is also possible to apply the outer tube 201 to the first embodiment of the invention.

INDUSTRIAL APPLICABILITY

According to the invention, a swing nozzle can be provided in which it is possible to stably perform a swing movement in a plane.

REFERENCE SIGNS LIST

1, 100: swing nozzle
11, 101: base
12, 102: frame
13, 103: support body
14, 104: pipe body
15: moving body
50: mesh hose (flexible section)
56: opening portion
65, 155: support position adjustment section
70: guide mechanism
73, 74: cam
75, 76: cam follower
77, 78: coil spring (biasing member)
140: tube (flexible section)
145: opening member (opening portion)

The invention claimed is:

1. A swing nozzle comprising:

a base;

a frame, which has a pair of lengthy main plates each having a long shape and the base end side of which is turnably supported on the base;

a support body which is supported on the leading end side of the frame so as to be able to turn around a turning center axis parallel to a turning center axis of the frame with respect to the base; and a pipe body which is supported on the base and the support body in a state where a flexible section, which can be elastically deformed and is provided between the base and the support body, is bent and which discharges a fluid from an opening portion of an opposite end to the base, wherein a reciprocating movement of a forward stroke and backward stroke are performed with a force that is generated by the fluid that enters into the pipe body;

a forward stroke that is the turning of the frame toward a first side with respect to the base by a discharge reactive force which is input from the pipe body to the support body at the time of fluid discharge and thus a bend state of the flexible section is reversed, the frame is turned to a turning end on the first side by a biasing force caused by an elastic deformation of the flexible section, a backward stroke that is the turning of the frame toward a second side with respect to the base by the discharge reactive force and thus a bend state of the flexible section is reversed, the frame is turned to a turning end on the second side by the biasing force of the flexible section, the frame whose base end side of the main plate on the first side is disposed outside the support plate section on the first side of the base and the base end side of the main plate is turnably supported by a turning shaft having a threaded portion provided perpendicular to the support plate section, and the frame whose base end side of the main plate on the second side is disposed outside the support plate section on the second side of the base and the base end side of the main plate is turnably supported by a turning shaft provided coaxially with the turning shaft at the support plate section.

2. The swing nozzle according to claim 1, wherein a support position adjustment section capable of adjusting a support position of the pipe body is provided at the support body.

* * * * *